United States Patent [19]

Horvath

[11] 4,405,131

[45] Sep. 20, 1983

[54] PUZZLE CUBE

[76] Inventor: Tibor Horvath, 1877 E. 27th St., Brooklyn, N.Y. 11229

[21] Appl. No.: 305,479

[22] Filed: Sep. 25, 1981

[51] Int. Cl.[3] ..... A63F 9/08

[52] U.S. Cl. ..... 273/153 S

[58] Field of Search ..... 273/153 S, 155

[56] References Cited

U.S. PATENT DOCUMENTS 3,081,089 3/1963 Gustafson ..... 273/160 X 4,344,623 8/1982 Isobe ..... 273/153 S

FOREIGN PATENT DOCUMENTS 55-8193 3/1980 Japan ..... 273/153 S

*Primary Examiner*—Anton O. Oechsle

*Attorney, Agent, or Firm*—Howard C. Miskin

[57] ABSTRACT

A puzzle device similar to that sold under the registered trademark RUBIK'S CUBE includes a hub with six orthogonally related square sockets, six mutually spaced circular retainers having inner and outer faces lying in spherical planes spaced from and concentric with the hub and coupled to respective sockets by square shanks, seven triangular slide members slidably underlying and bridging adjacent retainers and having outwardly projecting triangular shanks, an interlocking member having three ribs each of which is anchored in one of the recesses in the retainer, and three tongues each of which releasably engages recesses formed in the slide member peripheries and face members connected to the triangular shanks and having outside faces forming a regular three dimensional figure when the slide, retainer and interlocking member is in interlocked condition. The face members may have many different shapes, for example square, triangular, flattened spherical quadrants and form respectively different configurations. The slide member supported face members are rotatable in groups of four about selected orthogonally related axes.

12 Claims, 19 Drawing Figures

PUZZLE CUBE

BACKGROUND OF THE INVENTION

The present invention relates generally to improvements in puzzle devices and it relates particularly to an improved puzzle device of the type in which groups of elements are rotatable about selected orthogonally related axes to move individual elements into a predetermined relationship.

A puzzle device which is highly popular is that sold under the trademark RUBIK'S CUBE in which a main cube is divided into groups of minor cubes of nine cubes disposed three by three along each face of the main cube. Each of the groups of cubes being independently rotated about an axis perpendicular to the plane of the group, the axes of the groups being othorgonally related. The faces of the minor cubes are variously colored and it is the general object of the puzzle to successively rotate the groups about their respective axes from a random arrangement of the minor cubes to a condition wherein the minor cubes achieve a predetermined arrangement, for example with the faces of the minor cubes in a group being of the same color.

However, the RUBIK'S CUBE heretofore available possesses numerous drawbacks and disadvantages. The solution of the puzzle is difficult and very highly time consuming. Furthermore, the structure of the RUBIK'S CUBE is complicated allowing for no variations on the general modus operandi of the device and only limited and superficial variations in its configuration and appearance. Thus the conventional RUBIK'S CUBE leaves much to be desired in its application, construction and operation.

SUMMARY OF THE INVENTION

It is a principal object of the present invention to provide a simplified but improved puzzle device.

Another object of the present invention is to provide an improved puzzle device of the type wherein elements of an assembled unit are movable in three dimensions into different spacial relationships of the elements.

Still another object of the present invention is to provide an improved puzzle device of the RUBIK'S CUBE type.

A further object of the present invention is to provide an improved puzzle device of the above nature characterized by its ruggedness and ease of assembly and operation, low cost, attractive appearance and great versitility and adaptability.

The above and other objects of the present invention will become apparent from a reading of the following description taken in conjunction with the accompanying drawings which illustrate preferred embodiments thereof.

A puzzle device in accordance with the present invention comprises the assembly of a central core member, a plurality of mutually spaced retainer members connected to, spaced from and surrounding the core member and having inside faces lying in a spherical plane concentric with the core member, a plurality of peripherally spaced slide members underlying the retainer members and slidable in circular paths about orthogonally related axes intersecting at the center of said spherical plane and a face member connected to each of the slide members and disposed outwardly of the slide and retainer members.

In the preferred form of the improved puzzle device the core member has six outwardly directed sockets of square transverse cross section arranged in pairs along orthogonally related axes and six retainer members are provided, each being circular and of spherical convex, concave configuration with four equally spaced notches formed in its periphery and having formed therewith a central square cross section shank engaging a respective socket. Seven slide members are provided, each being triangular and of spherical convex-concave configuration and underlying the retainer members and having a positioning recess in each edge and an outwardly directed shank of equalateral triangular cross section. A single locking member is disposed at the level of and relative to the retainer members and includes three radially projecting flexible tongues each of which releasably engages a slide member notch or recess to releasably lock the slide members in predetermined relative positions, and a triangular shank projects outwardly from the locking member. The face members each include mutually perpendicular outside faces and an inwardly diagonally directed socket engaging a corresponding triangular shank. The eight face members, in predetermined positions of the slide members constitute the corners of cubes with the free edges of each face member being contiguous with those of adjacent face members. Any two groups or layer of four face members perpendicular to a common axis are rotatable relative to each other about such axis from one locked position for one or more 90° increments to another locked position. The face members may be of shapes other than that of the corners of a cube, and shapes other than that of a cube achieved in the adjusted predetermined positions of the face member carrying members.

The improved puzzle device is rugged, easy to assemble and operate and of great versitility and adaptability.

DESCRIPTION OF THE PREFERRED EMBODIMENTS

Figure 1:
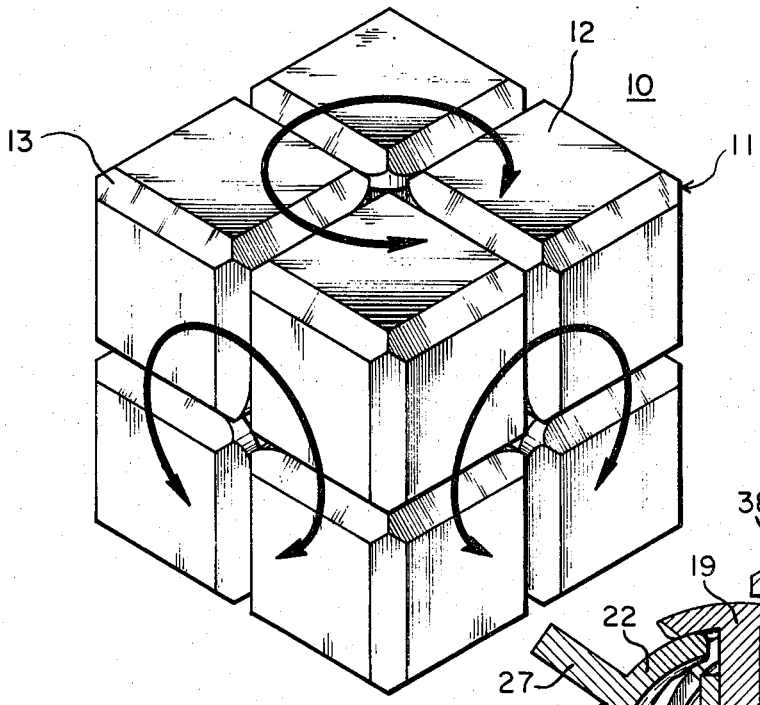
FIG. 1 is a perspective view of a puzzle device embodying the present invention.
Figure 2A:
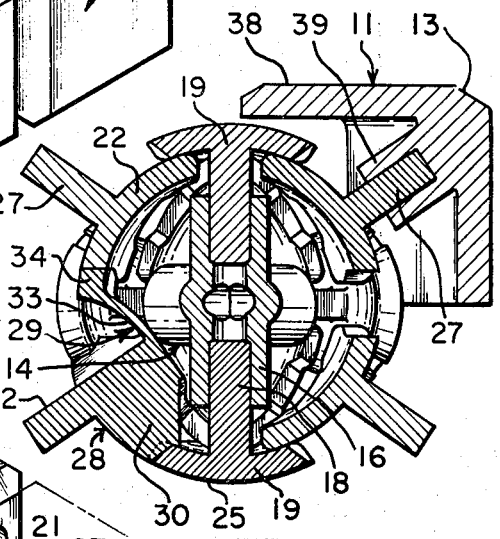
FIG. 2A is a sectional view taken along line 2A—2A in FIG. 2.
Figure 2:
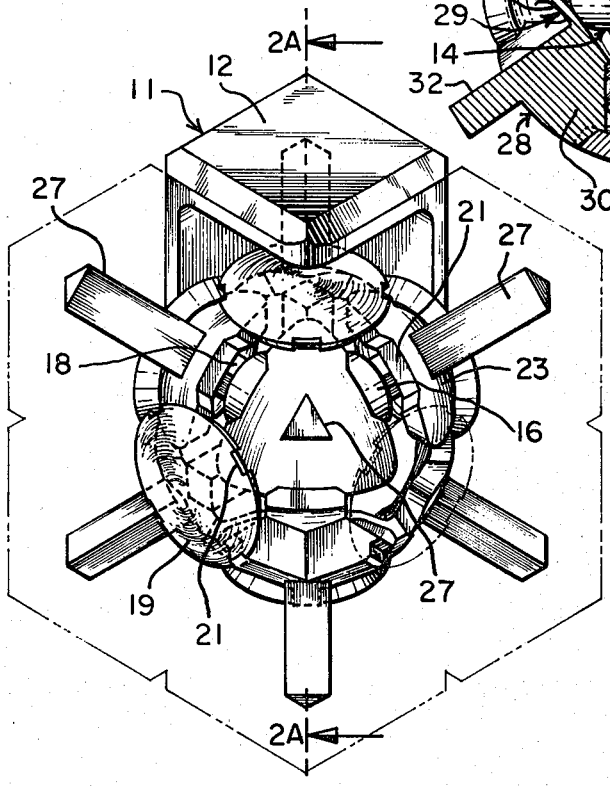
FIG. 2 is a perspective view thereof, partially broken away to show the internal mechanism.
Figure 3:
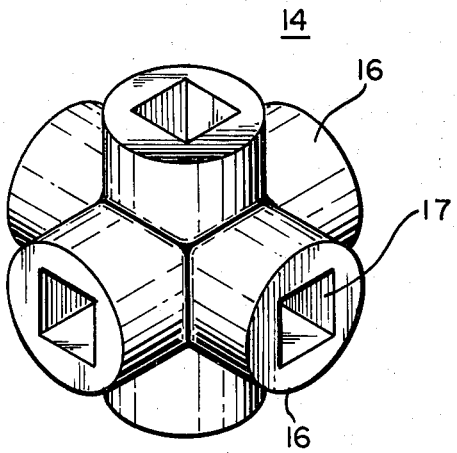
FIG. 3 is a perspective view of the core member of the device.
Figure 4:
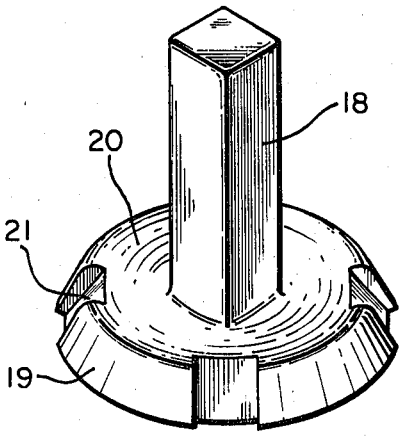
FIG. 4 is a bottom perspective view of one of the retainer members.
Figure 5:
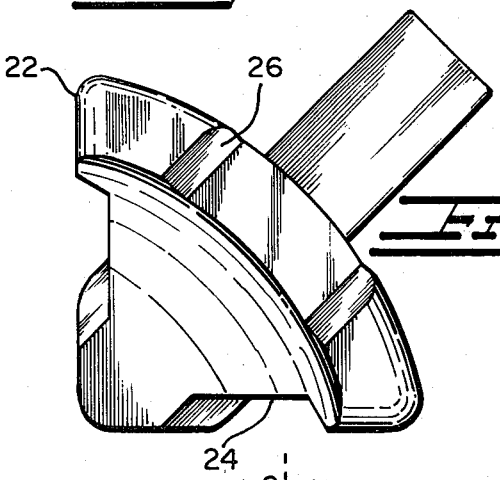
FIG. 5 is a bottom perspective view of one of the slide members.
Figure 6:
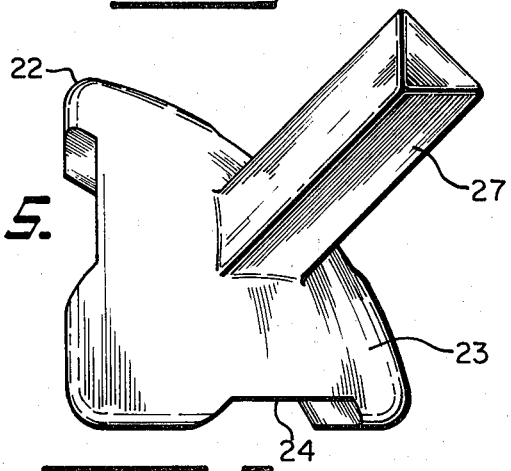
FIG. 6 is a top perspective view thereof.
Figure 7:
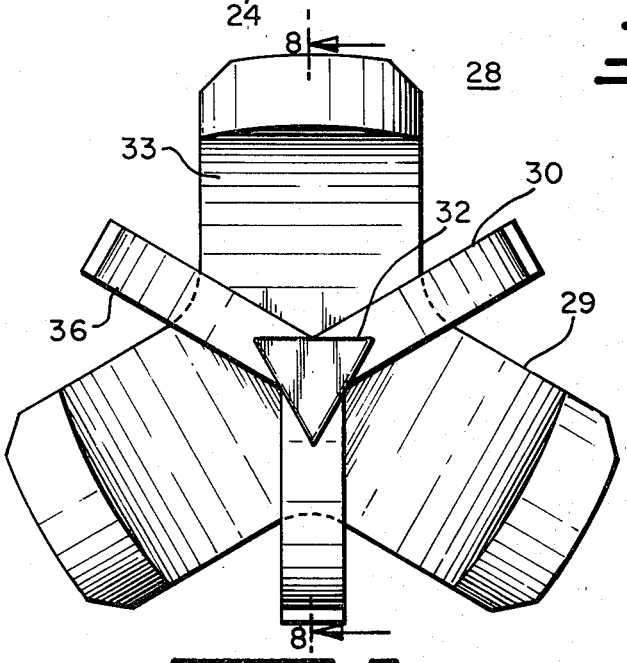
FIG. 7 is a top plan view of the locking member.
Figure 8:
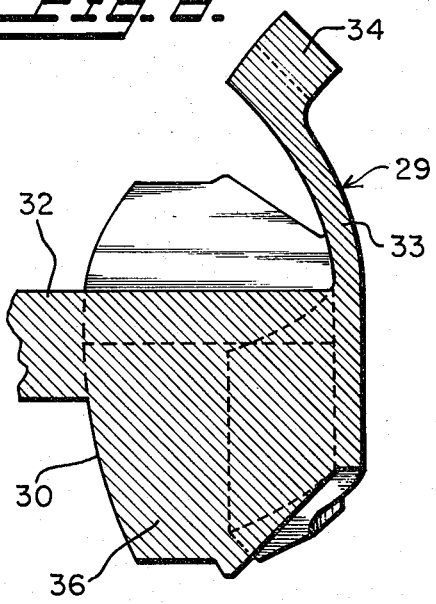
FIG. 8 is a sectional view taken along line 8—8 in FIG. 7.
Figure 9:
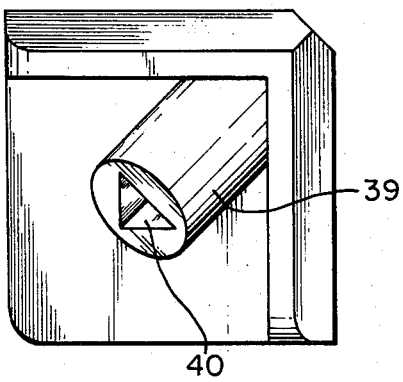
FIG. 9 is a rear elevational view of one of the face members.

Referring now to the drawings, particularly FIGS. 1 to 10 thereof which illustrate a preferred embodiment of the present invention the reference numeral 10 generally designates the improved puzzle device which, in the shown embodiment, is in its normal condition in the shape of a cube formed of eight face members 11 which are located at each corner of the cube and having three mutually perpendicular or orthogonally related outside faces 12 and bevelled edges 13. The free edges of each face member 11 is contiguous to those of adjacent face members 11 and each of the outside faces 12 may be colored or marked as desired so that the solution or solutions of the puzzle may be readily identified by the relationships of the faces 12.

The puzzle device 10 includes a central core member or hub 14 in the form of a six armed three dimensional spider having six orthogonally related pairs of coaxially related integrally formed cylindrical socket members 16 having similarly oriented axial bores or sockets 17 of square transverse cross section.

Engaging each of the sockets 17 and projecting axially radially outwardly therefrom is a respective square shank 18 formed integrally with and projecting centrally and perpendiculary from a retainer member defining circular head 19. The head 19 has a spherical concave inside face 20 and a spherical convex outside face 25, the faces 20 and 25 of the six retainer members 19 lying in respective inner and outer spherical planes concentric with hub 14 with the inside faces being spaced from hub 14 and the retainer members being relatively orthogonally positioned and mutually spaced. Formed in the peripheral face of each head 19 are spaced rectangular positioning recesses 21 which are in diagonal registry with the corner edges of the respective shank 18.

Seven slide members 22 underly and are slidable along the spherical underfaces 20 of retainer members 19, each slide member 22 being of equilateral triangular outline and having a spherical convex outer face 23 bridging and matchingly slidably engaging a plurality of retainer member underfaces 20 and a spherical concave underface. Medially formed in each of the sides of each slide member 22 is an elongated positioning recess 24 having inwardly converging end faces 26. An elongated shank 27 of equilateral triangular transverse cross section is integrally formed with and projects outwardly from each slide member 22 and has its sides parallel to the side edges of the slide member.

An interlocking member 28 locked in between three retainer members 19 releasably interlocks slide members 22 in the cube forming positions of the face members 11. Interlocking member 28 is an integral unit including three outwardly radially directed tongues 29 mutually angularly spaced 120° and three outwardly radially directed ribs 30 interdigitating the tongues 29. Integrally formed with and projecting outwardly from the center of interlocking member 28 is a triangular shank 32 similar to shanks 27.

Each of tongues 29 includes a flat arm extending along the inside portion of interlocking member 28 and being flexible along the direction of shank 29, flexible arm 33 terminating at its free end in an inwardly projecting plug section 34 disposed immediately below spherical faces 20 and matingly releasably engagable with a slide member recess 24. Each of ribs 30 includes a longitudinally extending wing 36 whose outer free end edge is anchored with a retainer member recess 21 and is provided at its inner edge with a shoulder 37 which locks in with the underface of the respective retainer member 19. In the assembled condition of puzzle device 10 with the face elements 11 forming a cube, each of tongues 29 of the interlocking member 28 releasably engages a recess 24 of a different slide member 22, and the triangular shanks 27 and 32 project outwardly to the corner delineated by walls 38, the socket member 39 having a socket 40 of triangular transverse cross section and in mating engagement with the outer end of a respective shank 27, 32. The sockets 17 and 40 and the shanks 18, 27 and 32 are so oriented and related that in the interlocked positions of the slide members and interlocking members, the face members 11 form a cube with the shanks 27 and 32 lying along the diagonals of the cube.

Figure 10:
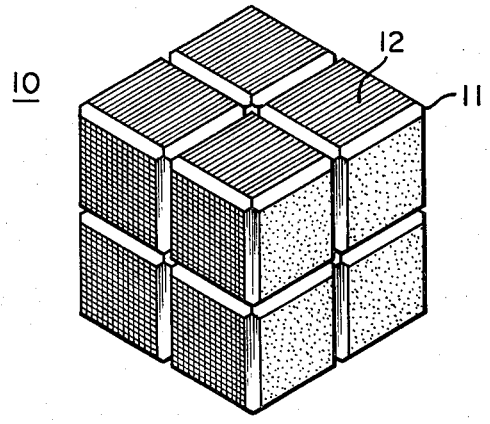
FIG. 10 is a perspective view of the puzzle device in a puzzle solved condition.

As heretofore explained, the faces 12 of each face member 11 may be of different colors, for example, red, green and yellow respectively, and the object of the puzzle is to rotate successive layers or groups of face elements 11 about the central axis perpendicular to the group, in the proper sequence, to bring the faces 12 from a random distribution to a predetermined pattern or arrangement, for example, with the faces 12 at each face of the cube being of the same color as illustrated in FIG. 10. When a group of face members 12 is rotated from its normal position one of tongues 29 is disengaged from its mating position with one of recesses 24 until the group is rotated 90° at which time one of the other recesses is releasably engaged by the tongue to releasably lock the face members in a cube delineating relationship.

Figure 11:
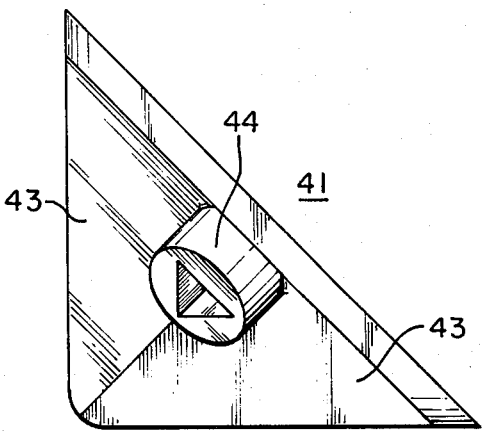
FIG. 11 is a view similar to FIG. 9 of a modified face member.
Figure 12:
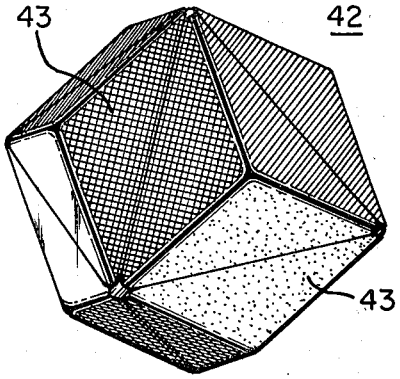
FIG. 12 is a view similar to FIG. 10 of a device with the face members of FIG. 11.

In FIGS. 11 and 12 of the drawings there is illustrated another embodiment of the present invention which differs from that described above only in the configuration of the face members 41 and the consequent shape of the assembled puzzle device 42. Specifically, each of the face members 41 includes three similar symmetrical triangular walls integrally joined along their symmetrical edges with their apices coinciding to form a tetrahedron shape. A socket member 44 corresponding to socket member 39 projects inwardly from the apex of walls 43 and engages a corresponding slide or interlocking member shaft. In all other respects the puzzle device 42 is similar to the puzzle device 10 described earlier and the polyhedron normally formed by the face members 41 is shown in FIG. 12.

Figure 13:
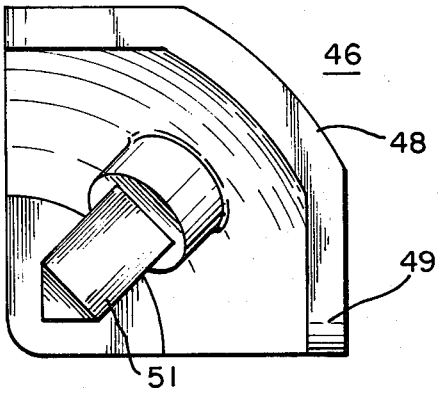
FIG. 13 is a view similar to FIG. 9 of another modified face member.
Figure 14:
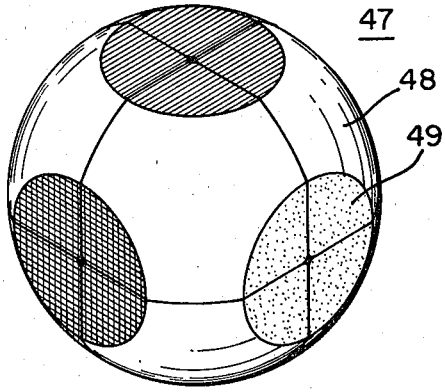
FIG. 14 is a view similar to FIG. 10 of a device with the face members of FIG. 13.

A further embodiment of the present invention is shown in FIGS. 13 and 14 and differs from those earlier described only in the shape of the face members 46 which is normal interlocked position of the modified puzzle device provides the configuration shown in FIG. 14. The outside face 48 of face member 46 is that of that section of a sphere delineated by the outer face of the sphere and three mutually perpendicular planes intersecting at the center of the sphere, the corners of the spherical face being flattened at the corners thereof to form quadrants 49. A shank member 51 projects inwardly from the concave inside face of each face member 46 and engages a corresponding socket member (not shown) of a slide or interlocking member of the puzzle device 47 in the manner earlier described and in all other respects the device 47 is similar to the device 10 and in its normal assembled interlocked condition is of the shape of a sphere flattened at the six quadrant points thereof.

Figure 15:
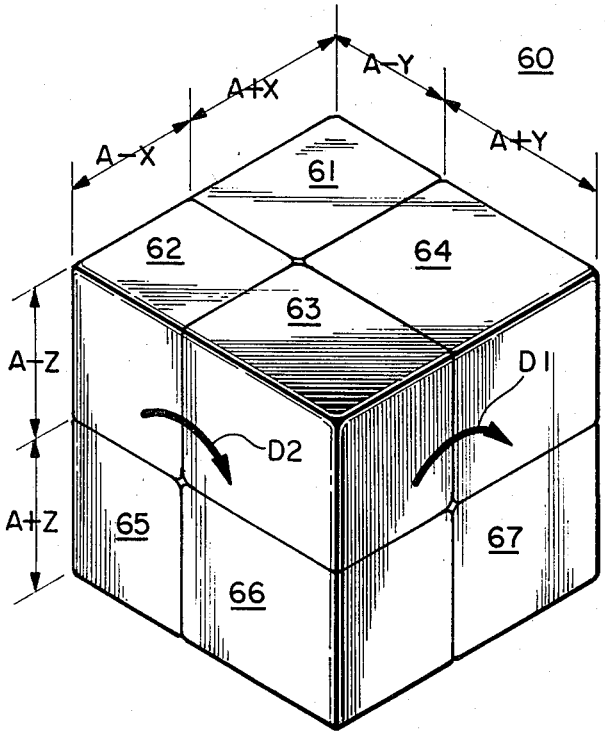
FIG. 15 is a perspective view of still another modified puzzle in puzzle solved condition.

Still another embodiment of the present invention is shown in FIGS. 15 through 18 and differs from those earlier described not only in the shape of the face members 61 through 67 (one face member is hidden from view) but in said face members size in relation to each other. While all previous embodiments included face members which were symmetricaly designed. Puzzle device 60 employs face members which are assymetrical in relation to their respective socket MEMBER, see FIGS. 17 and 18. The size differentials are indicated in FIG. 15. Thus just a couple of 90° turns first in the direction of D1 then D2 will result in the seemingly vastly disordered configuration shown in FIG. 16. These face members need not be color coded as they're coded by their shape and size.

Figure 17:
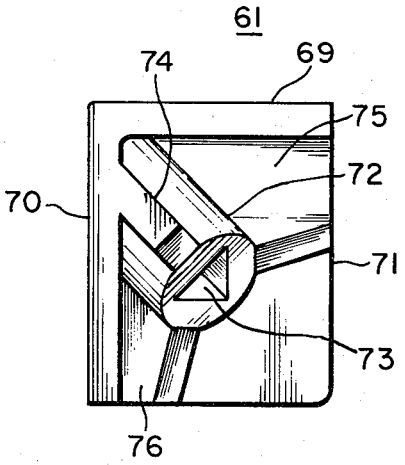
FIG. 17 is a rear elevational view of one of the face members of FIG. 15.
Figure 18:
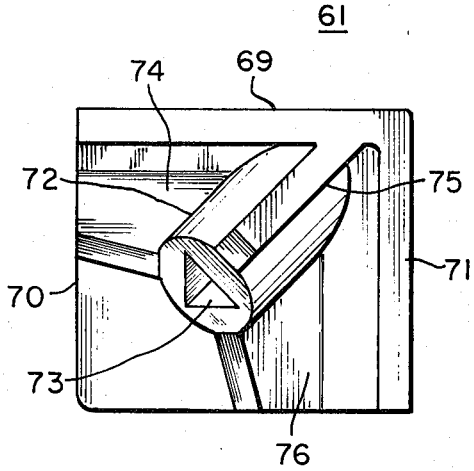
FIG. 18 is another elevational view of the same face member of FIG. 17.

Specifically, each of the face members, as typified by face member 61 shown in detail in FIGS. 17 and 18, has three orthogonally related rectangular side walls 69, 70 and 71 of different dimensions, the vertical edges of each face member, being either A−Z or A+Z, the longitudinal edges being A−Y or A+Y and the transverse edges being A−X or A+X in dimensions, the overall dimensions of each face member being different from those of any of the other face members, as seen from FIG. 15.

Figure 16:
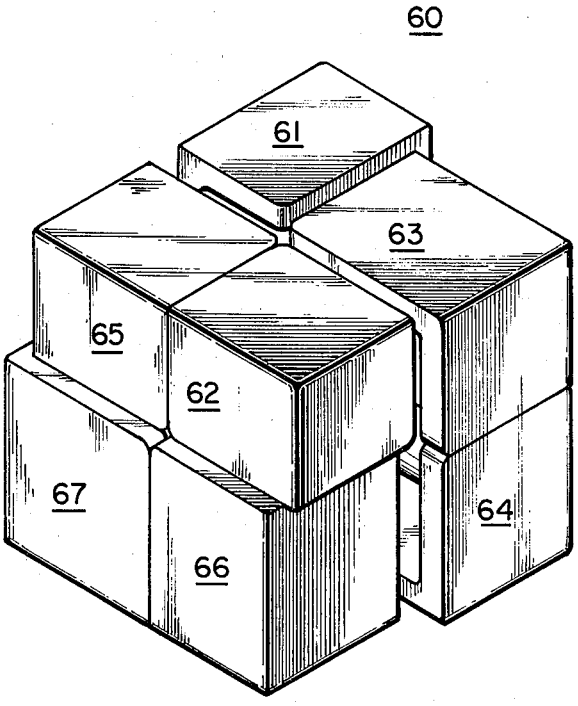
FIG. 16 is a perspective view of the same puzzle as FIG. 15 in puzzle unsolved condition.

The assembly and construction of the core member, retainer members slide members and locking members are similar to those of the earlier described embodiments but differs therefrom in that the assembly is eccentric to the center of the solved cube as shown in FIG. 16 whereas in the earlier embodiments the assembly is at the center of the solved puzzle body. Each of the face members includes a socket member 72 having a triangular axial socket 73 which is engaged by a corresponding slide or locking member shaft, the dimensions and orientation of each socket member 39 being such that in the solved condition of the cube the adjacent edges of the face members are contiguous and coexentive. Each of the socket members 72 is reinforced by integrally formed gusset plates 74, 75 and 76 extending between each socket member 72 and corresponding walls of the respective face member.

While there have been described and illustrated preferred embodiments of the present invention it is apparent that numerous alterations, omissions and additions may be made without departing from the spirit thereof.

I claim:

1. A puzzle device comprising;

an inner core member;

a plurality of mutually spaced retainer members connected to and spaced from and surrounding said core member and having inside faces lying in a spherical plane concentric with said core member;

a plurality of peripherally spaced slide members underlying said retainer member inside faces and each being movable in circular paths about orthgonally related axes intersecting at the center of said spherical plane;

a face member connected to each of said slide members and disposed outwardly of said slide and retainer members; including one interlocking member having a plurality of rib elements in locking engagement with three of said retainer members and a plurality of tongue elements in releasable locking engagement with three of said slide members; and a face member connected to said interlocking member.

2. The puzzle device of claim 1 including six of said retainer members and shanks extending radially outwardly from said core member and joining said retainer members, and one said interlocking member, said shanks being disposed along mutually orthogonal axes.

3. The puzzle device of claim 2 including a second shank extending outwardly from each of said slide and interlocking members and joining a respective face member.

4. The puzzle device of claim 2 wherein each of said retainer members is substantially circular with spherical concave and convex inside and outside faces respectively and has four recesses formed in the periphery thereof mutually spaced at 90°, selected one of said recesses in selected ones of said retainer members being lockably engagable by said locking rib elements.

5. The puzzle device of claim 1 wherein each of said slide members has respectively spherical concave and convex inside and outside faces and has three 120° spaced recesses formed in the peripheries thereof releasably engageable by said interlocking tongue elements.

6. The puzzle device of claim 1 wherein said interlocking member includes three said interlocking tongue elements, and three said interlocking rib elements.

7. The puzzle device of claim 1 wherein each of said face members comprises three square mutually perpendicular outer faces, and in predetermined relative positions thereof have outer edges contiguous with the corresponding edges of adjacent face members to delineate a cube.

8. The puzzle device of claim 1 wherein each of said face members is pyramidal with three similar equilateral outer faces converging to an apex.

9. The puzzle device of claim 1 wherein each of said face members has a spherical outer face in at least part thereof and has border edges lying in mutually perpendicular planes.

10. The puzzle device of claim 1 wherein each of said face members is different in physical size or shape from the other.

11. The puzzle device of claim 1 wherein said face members are of different dimensions and in a predetermined relative relationship have outer contiguous faced delineating a predetermined figure eccentric to said inner core member.

12. The puzzle device of claim 1 wherein said core member and the assembled face members are concentric.

* * * * *